US007331270B2

(12) United States Patent
Booher

(10) Patent No.: US 7,331,270 B2
(45) Date of Patent: Feb. 19, 2008

(54) PULTRUDED NON-METALLIC DAMAGE-TOLERANT HARD BALLISTIC LAMINATE AND METHOD OF MANUFACTURE THEREOF

(76) Inventor: Benjamin V. Booher, Scottsdale Industrial Airpark, P.O. Box 14664, Scottsdale, AZ (US) 85267-4664

( * ) Notice: Subject to any disclaimer, the term of this patent is extended or adjusted under 35 U.S.C. 154(b) by 0 days.

(21) Appl. No.: 11/051,309

(22) Filed: Feb. 4, 2005

(65) Prior Publication Data

US 2007/0295198 A1 Dec. 27, 2007

(51) Int. Cl.
*F41H 5/04* (2006.01)
*F41H 5/06* (2006.01)

(52) U.S. Cl. ..... 89/36.02; 109/49.5

(58) Field of Classification Search .... 89/36.01–36.17; 273/408; 109/49.5
See application file for complete search history.

(56) References Cited

U.S. PATENT DOCUMENTS 3,837,985 A * 9/1974 Chase ..... 428/223
5,070,764 A * 12/1991 Shevach et al. ..... 89/36.17
5,102,723 A * 4/1992 Pepin ..... 428/223
5,156,787 A 10/1992 Booher
5,354,066 A * 10/1994 Swanson et al. ..... 273/408
5,462,620 A 10/1995 Booher
5,495,922 A 3/1996 Booher
5,591,933 A * 1/1997 Li et al. ..... 89/36.02
5,690,770 A 11/1997 Booher
RE36,705 E 5/2000 Booher ..... 156/177
6,479,413 B1 11/2002 Booher
6,526,861 B1 * 3/2003 Gruber ..... 89/36.04

* cited by examiner

*Primary Examiner*—Bret Hayes
(74) *Attorney, Agent, or Firm*—Steptoe & Johnson LLP

(57) ABSTRACT

A lightweight and highly effective armor in which engineered ballistic broad goods are encased in exacting alignment within a specialized housing, composed of a polymeric composite, which is simultaneously formed around the dry broad goods by a pultrusion manufacturing process. The product finds use as protective armoring for vehicles, personal armor, siding and roofing for existing structures, and structural panels for construction of ballistic resistant structures.

39 Claims, 2 Drawing Sheets

PULTRUDED NON-METALLIC DAMAGE-TOLERANT HARD BALLISTIC LAMINATE AND METHOD OF MANUFACTURE THEREOF

BACKGROUND OF THE INVENTION

1. Field of the Invention

The invention herein relates to the field of armor to protect vehicles and other objects against damage from ballistic devices such as small arms ammunition, fragmentation from explosive devices, and the like. More particularly it relates to "non-metallic" armor, i.e., armor that is not composed primarily or wholly of metal.

2. Background of the Invention

As all are aware, armed confrontations are commonplace in today's world. Such confrontations range from organized warfare to urban police encounters and include such activities as guerrilla warfare, exchanges between security forces and irregulars, urban police encounters with gangs or individual criminals, and terrorist attacks. Targets of such attacks and encounters may be military personnel, police, and other security forces, or civilians, either as individuals or in small groups.

When people who anticipate that they might be the targets of such attacks are in open areas, many commonly wear body armor to prevent injuries from bullets or fragmented metal from explosive devices. Police officers, military personnel and security officers commonly wear such body armor. However, when such people are riding in vehicles, due to issues of practicality and comfort, many do not wear the body armor. Further, civilians who are riding in vehicles do not normally have body armor even if it would be valuable to wear it, since most do not anticipate that they will be attack targets. For those riding in a vehicle, the best protection is to armor the vehicle. Armoring of the vehicles has been done for a long time. Normally such armoring has involved attachment of heavy metal plates (usually steel plates) to the exterior of the vehicles or, where vehicle appearance remains important, placed within the body walls and doors of the vehicle. Such metal plates are usually extremely heavy, very difficult to install, adversely affect the performance of the vehicle, and are costly. All of these adverse factors affect not only the use of armoring for civilian vehicles such as cars and trucks but also armoring of military vehicles, since the military has limited funds and personnel available for extensive armor-related projects.

It would therefore be of considerable value to have available vehicle armor which is lightweight, highly effective, readily installed and replaced if damaged and which is available at reasonable cost, to insure that the maximum number of vehicles can be armored and the armor can be readily maintained by immediately available personnel without major diversion of such personnel from other necessary duties. It would further be valuable for such armor to also be useful for protection of other structures than vehicles, such as building of many types, including hard-wall and soft-wall buildings. In addition, it would be valuable to have a method for the manufacture of such armor based on a refined, well-developed, technically advanced process, which provides high production rates and high quality product, and which is also cost-effective. It is the purpose of the present invention to provide such armor and such a method for its manufacture.

SUMMARY OF THE INVENTION

In its principal embodiment the invention herein consists of a lightweight, multilayer armor in which one or more layers of engineered protective broad goods are encased in an integral housing composed of a polymeric composite which is formed around the layers of broad goods by a pultrusion manufacturing process. The pultrusion encased armor (which I call "pultruded ballistic armor" or "PBA") can be formed in various shapes to conform to numerous vehicle types to which the armor is to be adapted. Most conveniently the armor is formed in a number of different standard dimensions as determined by the different vehicles which are to be armored, such that military units, security forces, police departments and the like can have their vehicles readily armored and also maintain an accessible and easily installable stockpile of replacement armor sections to allow rapid re-armoring and up-armoring of vehicles, since they may inevitably become damaged during their service life by enemy, terrorist or criminal attacks.

The pultruded ballistic armor products of the present invention may be used not only as protective armor for vehicles, but also for many other protective purposes. The products may be formed in such sizes and shapes as to be usable as hard personal armor, siding and roofing for structures, and structural panels for construction of ballistic resistant structures, Pultrusion processes in general are well known and thoroughly developed. They are best described in my prior U.S. Pat. Nos. 5,165,787 (1992); 5,462,620 (1995) and 5,495,922 (1996), with more recent aspects also described in my prior U.S. Pat. Nos. 5,690,770 (1997) and 6,479,413 (2002). In another embodiment of the present invention, a new type of pultrusion process is defined, in which the major difference between the prior art pultrusion processes (which are commonly used for production of solid-section products) and the process of this invention is that in the present invention the forming die and pre-form devices are designed to form a housing and simultaneously to lay in the broad goods sheets into the dry center of the housing, such that the pultruded armor product has the structure shown in FIGS. 1 and 2.

DETAILED DESCRIPTION AND PREFERRED EMBODIMENTS

Figure 1:
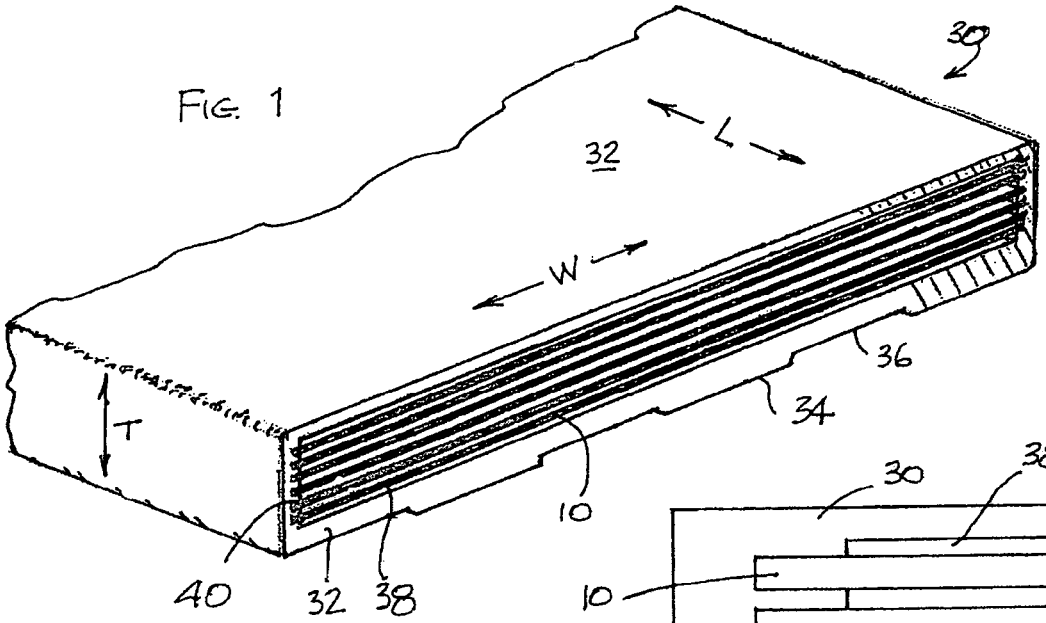
FIG. 1 is an end or cross-sectional view of a typical unit of pultruded ballistic armor of the present invention.

It is important to understand the nature of the present invention. The pultruded ballistic armor of this invention is a "non-metallic" armor. As defined herein, a "non-metallic" armor is one that is not primarily composed of metal. Tradition armor is formed from masses of metal, commonly iron or steel. While such metallic armor is commonplace today, and in fact many "armored" vehicles are either directly made of such metallic armor (e.g., the bodies of tanks) or are covered with sheets of such metallic armor, such is not relevant to the present invention. The present armor is a non-metallic armor that is formed with little or no metal. It finds primary use for application to "unarmored" vehicles, such as automobiles, utility vehicles and many kinds of trucks, of both light and heavy duty varieties, to provide for ballistic impact protection to such vehicles which (although of course being made in large part of metal) are not themselves capable of effectively withstanding such ballistic threats while protecting their contents and occupants.

The claimed non-metallic pultruded ballistic armor of the present invention and its method of manufacture using pultrusion are integrally related. The prior art has described other types of non-metallic armor and other non-metallic armor manufacturing processes. However, only by the novel pultrusion process described herein as part of the current invention can the armor of the present invention, with its superior properties, effectively be manufactured. It will be understood by those in the art reading in the descriptions and claims herein that the structure and properties of the present armor are unique. The scope of the present invention therefore is based on the intersection of the product and its method of manufacture. While the product and process of manufacture both incorporate elements from the prior art, the claimed products and method of manufacture represent combinations and enhanced performance which are significantly different from the structures and methods in which such prior art elements were found in the past.

The prior art non-metallic composite "hard" armors such as vehicle armors are typically manufactured by variations of a compression molding process that includes the steps of impregnating certain fibers in particular array with a resin system then curing the composite. This process is limited by its labor-intensive nature and inability to control fiber architecture. Current hard armor is also limited since the fibers do not remain independent within the cross section and are bonded or encapsulated within a resin matrix. That resin matrix compromises the material's ballistic capability by conforming the fibers and when subject to ballistic attack, by adding energized resin particles to the ballistic threat, which in turn can destroy the fibers intended to resist the primary ballistic or fragmentation threat. "Soft" armor, such as body armor, is constructed such as to provide multiple layers of suitable broad goods contained within some sort of flexible sleeve or soft encasement. The limitation here is that the fibers of the broad goods are exposed to shifting and bending that can compromise their ballistic value.

The current invention is designed to overcome the limitations of both these current products and manufacturing processes to provide an improved and cost effective hard armor for use on vehicles, structures and other similar applications. The pultrusion manufacturing process provides for securing and retaining engineered protective broad goods in exact orientation as a "dry laminate" during manufacturing and within the finished armor product. As the broad goods are pulled into position an outer hard-shell is simultaneously formed around the dry laminate. This hard shell forms a housing which uniquely secures the broad goods not only in exact orientation but also in prescribed tension. Since the broad goods thus remain dry within the final pultruded product, as differentiated from prior art armors, they are able to provide superior ballistic performance. Further, because of the hard encasement to the dry broad goods that characterizes the current invention, the broad goods layers are not subject to repeated bending or distortion that can cause abrading as occurs with soft armor. Conversely, unlike existing hard armor, the cross section of the current invention does not include a resin matrix that can compromise the individual ability of the fibers to the broad goods from performing their work in discharging kinetic energy from the ballistic threat; thereby providing maximum protection and damage tolerance.

The armor product of the present invention is formed by pultruding (i.e., drawing or pulling) one or preferable a plurality of sheets or layers of engineered dry ballistic resistant broad goods into the center of a fiber reinforced polymeric composite material body during its simultaneous formation by pultrusion and curing as a housing for the broad goods layers. This outer housing, which fully surrounds the dry broad goods, is resin impregnated roving and preferably also includes additional broad goods that together are formed and cured by the pultrusion process to wrap the dry ballistic engineered broad goods in a protective and structural covering. Upon curing of the polymeric material the broad goods layers become secured at their peripheries within the housing as will be described below.

Figure 4:
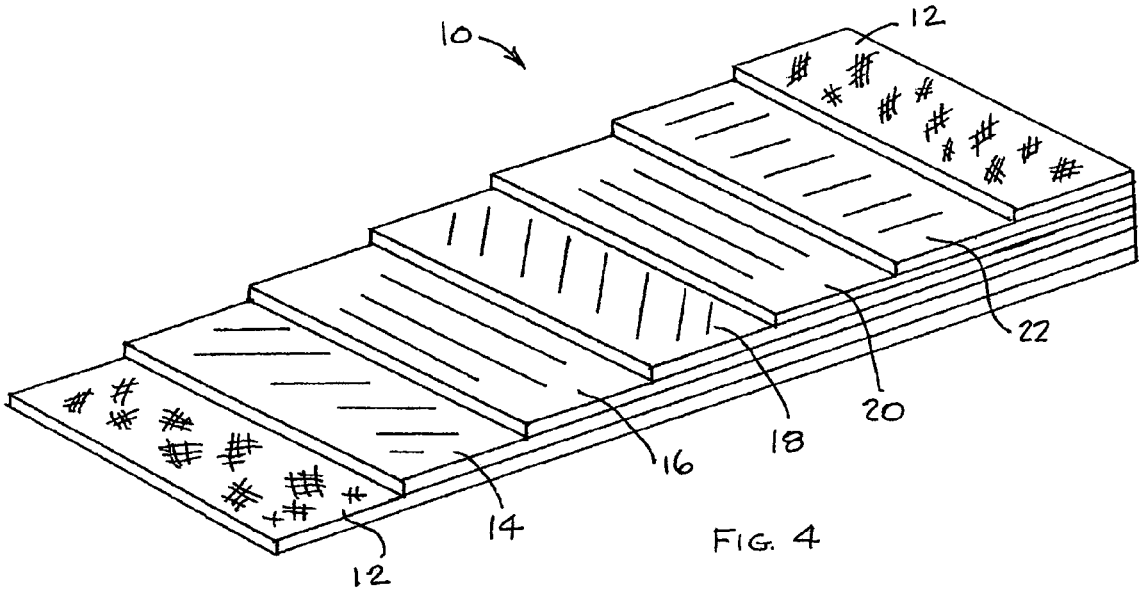
FIG. 4 is a schematic view of a typical ballistic impact-resistant broad goods sheet of the type useful in the present pultruded ballistic armor invention.

Engineered ballistic-resistance broad goods are well known, and many different types of commercially available materials may be used in the present invention. The concept of their effectiveness for protection against ballistic impact is well known. Essentially the broad goods are made as dry mats or weaves consisting of a multitude of fibers which, upon being struck by a projectile such as a bullet, deform, compact, and elongate to absorb and dissipate the kinetic energy of the projectile. The layering of multiple broad goods substantially increases the effectiveness of armor, as each successive layer further reduces the kinetic energy of a projectile. When the layers are in a multiple array, the tension of each layer and the spacing between them will preferably be such as to allow each layer to deform and elongate appropriately to provide the optimum absorption of energy at each layer; those skilled in the art can readily determine proper tension and spacing based on the ballistic impacts that the particular system is anticipated to encounter. This invention also contemplates that development of such broad goods will continue and that new such broad goods will come into the marketplace. It is anticipated that such newly developed broad goods will be equally applicable in the present invention as the current available materials. Suitable ballistic-resistant broad goods are commonly made of fibers that include but are not limited to glass fibers, aramid fibers (e.g., Kevlar®), or similar fibers or any combination thereof. The architecture of the basic broad goods may also vary from application to application. Specifications including the general fiber filament size, count, and type as well as the general fiber orientation to the woven, mat, or other "fabric" may vary—particularly as required for adaptation to the ballistic threat. A typical example is shown in FIG. 4, in which broad goods laminate 10 is formed of a series of fiber fabric sheets or layers 14, 16, 18, 20, 22 covered on both outer surfaces by protective fiber mats 12. The fibers in the layers have different orientations, to spread the effects of ballistic impacts; in the embodiment shown in FIG. 4, the fibers in layer 14 are oriented at −(20E-90E) (0E designating the longitudinal axis of the material with plus-angles being to the left in the Figure and minus-angles to the right, as indicated by the lining shown in each layer), layer 16, 90E; layer 18, +(20E-90E); layer 20, 90E; and layer 22, 0E. One particular fiber product of interest, due to its ready supply, satisfactory properties, and cost effectiveness is PPG Industries' Hybon™ 2022 Roving. While numerous varieties of this product exist, one that is particularly suitable is the 1800 yield, 275 TEX, K filament (13 micron) silane-sized continuous strand roving.

Figure 2:
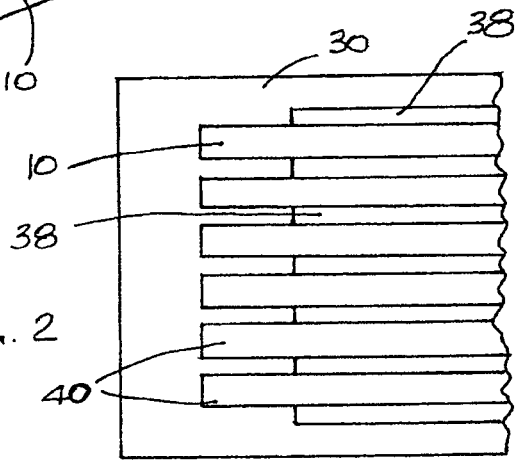
FIG. 2 is a detailed view of one side of the pultruded ballistic armor unit of FIG. 1, illustrating the interconnection of the armor layers and the enclosing housing.

The general configuration of the housing 32 with the encased broad goods sheets 10 to form the armor product 30 is illustrated in FIGS. 1 and 2. The housing 32 is formed around the edges 40 of multiple layers of broad goods 10 which are exactly oriented relative to each other and the main shell of the housing by a series of steps 38. The resin of the housing flows around the edges 40 of the sheets 10 as best seen in FIG. 2 and secures them in place with the desired tension and spacing with the steps 38. The laminate armor 30 thus consists of the housing and secured therein, the ballistic-resistance layers 10. Since the housing 32 is rigid, the armor is hard and the broad goods 10 are immobilized. However, since the broad goods are in contact with the housing resin only at their peripheries, they are "dry" over most of their expanse. If desired, the housing 32 can be formed during the pultrusion with lands 34 and valleys 36 running along the side of the armor product 30 which is to be attached to the vehicle. This aids in handling and storage of the products, mounting of each product to a vehicle, and retention of the product on the vehicle, the last since it allows for some expansion, contraction, moisture drainage, etc. of the vehicle body in different weather conditions.

The specifications of the outer impregnated and cured housing 32 that locks the highly engineered broad goods in absolute alignment within the finished products is also application specific. It is necessary to engineer the proper wall dimension of the housing 32 to provide the necessary structure to the specific application while also not impeding the ballistic component of the dry and precisely contained ballistic fibers. Therefore, it may be necessary and desirable in many applications for the wall thickness of the outer shell to vary. This further feature can provide a highly rigid structure to the inner face while presenting a less ridged, but fully environmentally resistant outer skin that will not adversely affect the physics involved in providing maximum efficiency to the disposition and management of kinetic energy imposed during a ballistic threat. Those skilled in the art can readily determine the appropriate thicknesses of housing wall for various vehicles and for ease of handling and intended performance. Typically the thickness (dimension "T" in FIG. 1) will be on the order of 0.50 to 1.50 inches (1.27 to 3.81 cm). The width ("W") dimension will be determined by the capabilities of the pultrusion equipment, while the length ("L") dimension is a matter of choice, since it represents where each armor product unit 30 is cut from the pultrusion as it exits from the manufacturing operation. Width capabilities of pultrusion equipment are commonly up to or beyond 50 inches (125 cm). The length dimensions will be determined primarily by the sizes most commonly needed and the ability of personnel to handle them easily. It is recognized that larger vehicle areas may need to be protected by more than a single armor pultrusion product can cover, so individual products 30 can be abutted on a vehicle as illustrated at 50 in FIG. 3.

The materials from which the housing 30 is made can be any of a variety of polymeric matrix materials, normally thermosetting materials, reinforced with any one or more of a variety of different fibrous materials. Suitable thermosetting matrix polymers include, but are not limited to, crosslinked polyethylene or polypropylene, phenolics, epoxides, polyesters and silicones. Reinforcing fiber yarns and strands may be of glass, ceramic, graphite, silica and the like.

Figure 3:
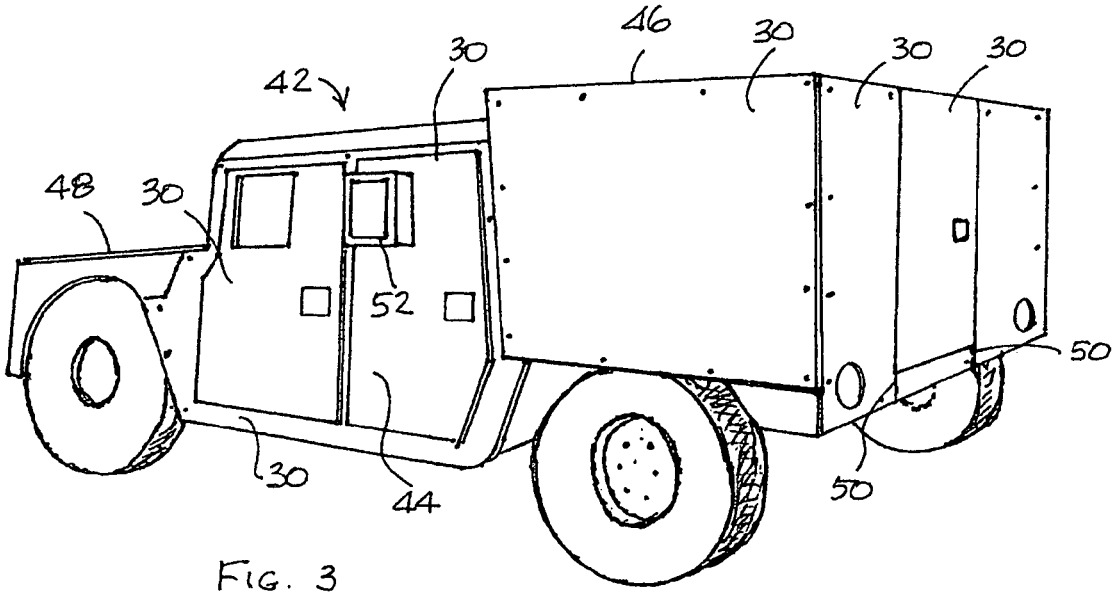
FIG. 3 is a perspective view of a typical vehicle to which the pultruded armor of the present invention has been attached.

The application of the armor products 30 is illustrated in FIG. 3, which shows a typical military or utility vehicle 42 of conventional configuration having a cab 44 for the driver and passengers, a cargo compartment 46 and an engine compartment 48. Armor products 30 can be attached to any or all of these, as shown in the Figure. Attachment is in generally the same manner as used for metallic armor, of course recognizing that attachment will be much simplified over that of metallic armor because of the much lighter weight of the present invention. While wherever possible it is preferred to have the products 30 in the configuration of simple flat sheets, the products can be pultruded in various configurations including flat and curved panels of specifically engineered dimensions. It will be evident from FIG. 3 that many different shapes and sizes of the products 30 are contemplated. Normally doors, hoods, trunks and similar openable or liftable structures will be covered independently of the covering of the body of the vehicle, as shown, to facilitate operation of those structures. Small specialized product units can also be fabricated and used, as exemplified by the small box protective enclosure 52 shown surrounding a window on the rear door of the vehicle in FIG. 3.

It will be recognized that the hard armor products 30 of the present invention may be used not only as protective armor for vehicles, but also for many other protective purposes. The products may be formed in such sizes and shapes as to be usable as hard personal armor, siding and roofing for structures, structural panels for construction of ballistic resistant structures, and panels and sheets of the products may in an emergency simply be propped up for persons under attack to shelter behind. Those skilled in the art will recognize numerous other uses and applications for which the products of this invention may be employed.

Figure 5:
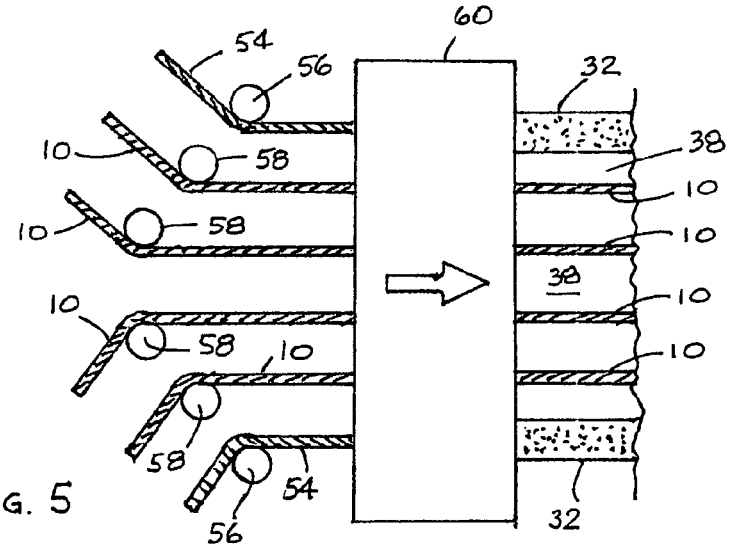
FIG. 5 is a schematic diagram of formation of the pultruded ballistic armor by use of the pultrusion process of this invention.

As noted, pultrusion processes in general are well known and thoroughly developed. They are best described in my prior U.S. Pat. Nos. 5,165,787 (1992); 5,462,620 (1995) and 5,495,922 (1996), with more recent aspects also described in my prior U.S. Pat. Nos. 5,690,770 (1997) and 6,479,413 (2002). Commercial pultrusion manufacturing plants are in current operation in the United States based on the principles described in these patents. In the present invention, the new pultrusion process differs from the prior art pultrusion processes (which are commonly used for production of solid-section products) in that the forming die 60 is structured to form a housing 32 instead of a solid friction material block, and simultaneously to lay in the broad goods 10 into the dry center of the housing 32, such that the pultruded armor product 30 has the structure shown in FIGS. 1 and 2. This is illustrated schematically in FIG. 5, in which the broad goods 10 are shown disposed to be fed over rollers 58 disposed between the rollers 56 for feeding in the fiber impregnated reinforced polymeric pultrusion stock 54. (The sheets 10 and stock 54 are shown as widely spaced for clarity in the diagram. They will of course actually have the appearance and close spacing otherwise described herein. Crosshatching is shown for the purpose of differentiating the different components and not for the purpose of defining materials.) In the embodiment shown there are four layers of broad goods 10; as discussed above any convenient number can be selected depending on the type of armor of interest. The assemblage passes through the forming die 60 in the direction of the arrow and in the manner well known for pultrusion and shown in my described patents, and when the assemblage exits from the forming die 60 the outside shell or housing 32 has been formed by curing of the polymeric stock 54 with the broad goods 10 secured therein with the proper locations and spacing steps 38. The armor products 30 may then be cut off seriatim at desired lengths as well known and illustrated in my prior patents.

The pultrusion process of the present invention is capable of producing pultruded ballistic armor products at the rate of up to 50 in/min (125 cm/min) or greater for panels of up to 50 in (125 cm) in width and wider. The process is well proven, and the current commercial control mechanisms in use allow for the desired reproducibility. The pultruded ballistic armor products of this invention characteristically have a weight of about 5 lb/ft$^2$ (24 kg/m$^2$). These have an effectiveness generally equal to that of ⅜ in (1 mm) thick RHA steel plates weighing 15 lb/ft$^2$ (72 kg/m$^2$). It will be evident that the PBA products are essentially three times more effective than steel plate on a weight basis, thus allowing substantial weight reduction on armored vehicles. Such weight reduction has substantial operational benefits, such as better fuel efficiency for the vehicle; ability for the vehicle to traverse roads, bridges or other structures that have low load-carrying capabilities; and, if desired, the ability for the vehicle itself to carry replacement panels for field repairs while still weighing less in total than a similar vehicle with metal armoring. Yet another benefit of the pultruded ballistic armor products of this invention are their thermal properties. Polymeric materials are well known to absorb less heat, maintain lower surface temperature and have substantially less thermal expansion and contraction that metal plates. Thus for a vehicle in use in a desert or other hot climate, the interior temperature of a PBA-armored vehicle in the sun will be significantly less than it would if the vehicle had been armored with metal plates. thus affording more comfort for the vehicle occupants and less likelihood of heat damage to vehicle contents—while also reducing the vehicle heat signature that can be used for targeting by the unfriendly force.

It will be evident that there are numerous embodiments of this invention which, while not expressly set forth above, are clearly within the scope and spirit of the invention. Therefore the above description is to be consider exemplary only, and the actual scope of the invention is to be defined solely by the appended claims.

I claim:

1. A non-metallic armor article comprising a pultruded housing having disposed therein at least one dry ballistic impact resistant broad goods sheet secured by the pultruded housing, the housing formed from a cured, fiber impregnated resin, opposing faces of said broad goods sheet being spaced from said housing and edge portions of said broad good sheet being in contact with said housing and fixed in position with respect thereto, said housing extending around a cross-section of said broad goods sheet remote from said edge portions and being integrally formed.

2. The non-metallic armor article of claim 1, wherein a plurality of broad goods sheets are disposed in said housing.

3. The non-metallic armor article of claim 2, wherein said broad goods sheets are aligned substantially in parallel and are spaced in precise array.

4. The non-metallic armor article of claim 3, wherein each said broad goods sheet is secured with a predetermined tension.

5. The non-metallic armor article of claim 2, wherein the plurality of broad goods sheets are coupled to the housing and not separately coupled to each other.

6. The non-metallic armor article of claim 1, wherein said housing comprises a polymeric material reinforced by a fibrous material extending therethrough.

7. The non-metallic armor article of claim 6, wherein said polymeric material comprises a thermosetting polymer.

8. The non-metallic armor article of claim 1 formed as a panel for attachment to a structure for armoring against ballistic attack.

9. The non-metallic armor article of claim 8, wherein said housing of said panel is adapted for said attachment to said structure.

10. The non-metallic armor article of claim 8, wherein said structure comprises a vehicle.

11. The non-metallic armor article of claim 8, wherein said structure comprises habitable enclosure.

12. The non-metallic armor article of claim 11, wherein said habitable enclosure comprises a building.

13. A non-metallic armor article comprising:

a housing formed of a fiber-impregnated, polymeric, pultruded material;

a plurality of sheets comprising ballistic impact resistant broad goods, the sheets further comprising periphery portions and face portions, the sheets being spaced from one another and opposing face portions thereof being spaced from said housing, the periphery portions of the sheets being in contact with the housing and fixed in position with respect thereto, the housing being integrally formed and substantially surrounding the sheets.

14. The non-metallic armor article of claim 13, wherein the periphery portions are embedded in interior walls defined by the housing.

15. The non-metallic armor article of claim 13, wherein open regions are defined between adjacent sheets.

16. The non-metallic armor article of claim 13, wherein each sheet is formed of a plurality of fabric layers comprising fibers.

17. The non-metallic armor article of claim 16, wherein the fibers of adjacent fabric layers are generally oriented transverse to each another.

18. The non-metallic armor article of claim 16, wherein the fibers are selected from the group consisting of glass fibers, aramid fibers, and combinations thereof.

19. The non-metallic armor article of claim 13, wherein the sheets are disposed substantially parallel to one another.

20. The non-metallic armor article of claim 13, wherein each sheet is secured to the housing with a predetermined tension.

21. The non-metallic armor article of claim 13, wherein the housing is formed of a thermosetting polymer.

22. The non-metallic armor article of claim 13, wherein the housing surrounds the sheets to provide an armor article thickness of between 0.5 inch and 1.5 inches.

23. The non-metallic armor article of claim 13 configured and dimensioned as a panel.

24. The non-metallic armor article of claim 23, wherein the panel has a width up to 50 inches.

25. The non-metallic armor article of claim 13, wherein the housing is rigid.

26. The non-metallic armor article of claim 13, wherein the sheets are coupled to the housing and not separately coupled to each other.

27. A non-metallic armor article comprising:

a rigid housing formed of a fiber-impregnated, polymeric, pultruded material;

a plurality of sheets each comprising ballistic impact resistant fabric, the sheets disposed with gaps therebetween and with peripheral portions disposed in fixed relation to the housing;

wherein the housing is formed of unitary construction, substantially surrounds the sheets, and secures the sheets in tension; and wherein the sheets are coupled to the housing and not separately coupled to each other.

28. The non-metallic armor article of claim 27, wherein the peripheral portions are embedded in interior walls defined by the housing.

29. The non-metallic armor article of claim 27, wherein each sheet is formed of a plurality of fabric layers comprising fibers.

30. The non-metallic armor article of claim 29, wherein the fibers of adjacent fabric layers are generally oriented transverse to each another.

31. The non-metallic armor article of claim 29, wherein the fibers are selected from the group consisting of glass fibers, aramid fibers, and combinations thereof.

32. The non-metallic armor article of claim 27, wherein the sheets are disposed substantially parallel to one another.

33. The non-metallic armor article of claim 27, wherein the housing is formed of a thermosetting polymer.

34. The non-metallic armor article of claim 33, wherein the thermosetting polymer is a phenolic.

35. The non-metallic armor article of claim 33, wherein the housing comprises polyester.

36. The non-metallic armor article of claim 27, wherein the housing surrounds the sheets to provide an armor article thickness of between 0.5 inch and 1.5 inches.

37. The non-metallic armor article of claim 27 configured and dimensioned as a panel with a width up to 50 inches.

38. The non-metallic armor article of claim 27, wherein the housing comprises lands and valleys on an outer surface thereof.

39. A non-metallic armor article comprising:

a housing formed of a fiber-impregnated, polymeric, pultruded material; and a plurality of sheets each comprising ballistic impact resistant fabric, the sheets coupled to the housing independent from one another, with peripheral portions of the sheets coupled to the housing in fixed relation thereto;

wherein the housing is formed of unitary construction, substantially surrounds the sheets, and secures the sheets in tension.

* * * * *